US008272846B2

(12) United States Patent
Flanigan et al.

(10) Patent No.: US 8,272,846 B2
(45) Date of Patent: Sep. 25, 2012

(54) INTEGRAL SLIDE VALVE RELIEF VALVE

(75) Inventors: Paul J. Flanigan, Cicero, NY (US); Peter J. Pileski, Manilius, NY (US)

(73) Assignee: Carrier Corporation, Farmington, CT (US)

( * ) Notice: Subject to any disclaimer, the term of this patent is extended or adjusted under 35 U.S.C. 154(b) by 532 days.

(21) Appl. No.: 12/517,624

(22) PCT Filed: Dec. 5, 2006

(86) PCT No.: PCT/US2006/046351

§ 371 (c)(1), (2), (4) Date: Jun. 4, 2009

(87) PCT Pub. No.: WO2008/069789

PCT Pub. Date: Jun. 12, 2008

(65) Prior Publication Data

US 2010/0047103 A1 Feb. 25, 2010

(51) Int. Cl.
*F04B 49/00* (2006.01)

(52) U.S. Cl. ..... 417/213; 417/310; 418/201.2

(58) Field of Classification Search ..... 417/201.2, 417/213, 310, 296; 418/201.2

See application file for complete search history.

(56) References Cited

U.S. PATENT DOCUMENTS 2,307,251 A * 1/1943 Woods et al. ..... 417/372
3,759,636 A * 9/1973 Schaefer et al. ..... 417/281
3,961,862 A * 6/1976 Edstrom et al. ..... 417/282
4,508,491 A * 4/1985 Schaefer ..... 417/310
4,678,406 A * 7/1987 Pillis et al. ..... 417/310
5,950,665 A 9/1999 Claus
6,779,350 B2 * 8/2004 Ramachandran et al. ..... 62/77
6,893,240 B2 * 5/2005 Bush et al. ..... 418/178

FOREIGN PATENT DOCUMENTS

JP 04043883 A * 2/1992
WO WO 2007106090 A1 * 9/2007

OTHER PUBLICATIONS

English translation of abstract/constitution of JP 04043883, Screw Compressor, Yamazaki et al., Feb. 13, 1992.*

* cited by examiner

*Primary Examiner* — Devon Kramer
*Assistant Examiner* — Ryan Gatzemeyer
(74) *Attorney, Agent, or Firm* — Bachman & LaPointe, P.C.

(57) ABSTRACT

Various embodiments of the invention provide a screw compressor for compressing a refrigerant in a refrigeration system. The screw compressor includes a rotor case, which accommodates a primary helical rotor that is intermeshed with at least one secondary helical rotor, to compress the refrigerant in the rotor case. The rotor case also includes a slide valve supporting member that is fixed on an inner wall of the rotor case. Moreover, a slide valve, located in the rotor case, slides axially on the slide valve supporting member. The slide valve controls the volume of refrigerant during compression. The slide valve is fitted with at least one internal pressure relief valve, to relieve internal pressure in the screw compressor.

21 Claims, 6 Drawing Sheets

INTEGRAL SLIDE VALVE RELIEF VALVE

BACKGROUND

The invention generally relates to screw compressors. More specifically, the invention relates to positioning an internal pressure relief valve in a screw compressor.

A screw compressor, in addition to a condenser, an expansion device, and an evaporator, is a key component of a refrigeration system. The screw compressor includes a common housing, hereinafter referred to as a 'rotor case', in which a primary helical rotor is intermeshed with at least one secondary helical rotor. The primary helical rotor is driven by an electric motor. Due to the intermeshing between the primary and secondary helical rotors, the secondary helical rotor is driven in counter-rotating motion by the rotation of the primary helical rotor. The function of the primary and secondary helical rotors is to compress a refrigerant entering the screw compressor in a gaseous state, hereinafter referred to as a 'refrigerant gas'. A refrigerant is a medium of heat transfer that produces a refrigeration effect by absorbing and dissipating heat in the refrigeration system. The refrigeration effect refers to the amount of cooling produced in the refrigeration system. The refrigerant gas enters the rotor case through an inlet port and gets trapped between the inner walls of the rotor case and grooves of the primary and secondary helical rotors. Due to the constant rotary motion of the primary and secondary helical rotors, the refrigerant gas gets compressed and is discharged through a discharge port. The compressed refrigerant gas then enters the condenser under high pressure. In the condenser, the refrigerant gas is cooled and thereafter liquefied by heat exchange with the air or water present in the condenser. Thereafter, the resulting refrigerant liquid is expanded in the expansion device and is brought down to a low pressure and temperature. The low pressure, low temperature refrigerant liquid is then supplied to the evaporator. In the evaporator, the refrigerant liquid absorbs the heat present in the evaporator and changes into gaseous state, thereby cooling the refrigeration system. Subsequently, the refrigerant gas leaves the evaporator and undergoes compression in the screw compressor, thus completing a refrigeration cycle.

To vary the refrigeration effect, the compression capacity of the refrigeration system needs to be controlled. The compression capacity refers to the volume of compressed refrigerant gas discharged from the screw compressor. The compression capacity is proportional to the refrigeration effect in the refrigeration system. In order to control the compression capacity, the rotor case of the screw compressor is provided with a slide valve. The slide valve controls the compression capacity by varying the volume of the refrigerant gas in a working chamber. The working chamber is defined by the inner walls of the rotor case of the screw compressor. This allows only the required volume of refrigerant gas to be compressed and discharged from the screw compressor.

During the process of compression, an over-pressure situation may arise in the screw compressor. During the over-pressure situation, the internal pressure of the screw compressor exceeds the maximum allowable internal pressure. This can cause damage to the screw compressor. In order to relieve excess internal pressure, an internal pressure relief valve is provided in the screw compressor. The internal pressure relief valve vents the excess internal pressure from the discharge side (high-pressure side) to the suction side (low-pressure side) of the screw compressor, thus preventing damage to the screw compressor.

FIG. 1 illustrates a view of a conventional screw compressor 100 with its components. Screw compressor 100 includes a rotor case 102, a slide valve supporting member 108, a slide valve 110, and two internal pressure relief valves 112*a* and 112*b*. Rotor case 102 accommodates a primary helical rotor 104 and a secondary helical rotor 106. Primary helical rotor 104 and secondary helical rotor 106 together compress the refrigerant gas in rotor case 102. Conventionally mounted internal pressure relief valves 112*a* and 112*b* take up a lot of space in screw compressor 100. Further, when the size of screw compressor 100 increases, either the size of internal pressure relief valves 112*a* and 112*b* have to be increased accordingly, or more internal pressure valves have to be accommodated in rotor case 102 of screw compressor 100. As a result, the amount of casting material required to manufacture rotor case 102 increases, thereby increasing the overall size, weight, and manufacturing cost of screw compressor 100.

In light of the foregoing discussion, there exists a need for an apparatus that relieves excess internal pressure in a screw compressor, without taking up any additional space, even when the size of the screw compressor is increased or multiple internal pressure valves have to be accommodated. Further, the apparatus should be arranged such that any extra amount of casting material or additional cost of manufacturing the rotor case of the screw compressor is avoided.

SUMMARY

An object of the invention is to provide a screw compressor for compressing a refrigerant in a refrigeration system.

Another object of the invention is to provide an apparatus for relieving excess internal pressure in the screw compressor.

Yet another object of the invention is to provide an apparatus which does not take up any additional space, even when the size of the screw compressor is increased or multiple internal pressure relief valves have to be accommodated Still another object of the invention is to provide a screw compressor that reduces the casting material and cost of manufacturing a rotor case of the screw compressor.

Still another object of the invention is to provide an apparatus that reduces the overall size and weight of the screw compressor, without changing the functionality of the screw compressor.

In order to achieve the above-mentioned objects, the invention provides a screw compressor that comprises a rotor case and an electric motor. The rotor case includes a primary helical rotor that is intermeshed with at least one secondary helical rotor, to compress a refrigerant in the rotor case. The rotor case also comprises an inlet opening for the refrigerant to enter the screw compressor. The refrigerant from the inlet opening enters the suction ports. Further, the refrigerant from the suction ports enters a working chamber, which is defined by space between the inner walls of the rotor case. A slide valve supporting member is fixed on the inner wall of the rotor case. The rotor case also accommodates a slide valve, which slides axially on the slide valve supporting member. The slide valve is fitted with at least one internal pressure relief valve that relieves excess internal pressure in the screw compressor.

In the screw compressor, the refrigerant enters the working chamber through the suction ports. The electric motor drives the primary helical rotor, which, in turn, drives the secondary helical rotor in a counter rotating motion. Due to the constant rotary motion, the refrigerant gets trapped between the helical grooves of the primary and the secondary helical rotors and is compressed to high pressure. The slide valve located in the rotor case provides compression capacity control by varying the volume of the refrigerant in the working chamber. In an embodiment of the invention, the compression capacity of the screw compressor can be decreased by exposing a portion of the working chamber to one of the suction ports. This vents a required volume of the refrigerant gas into one of the suction ports. Hence, only the remaining volume of the refrigerant in the working chamber is compressed. The internal pressure relief valves fitted in the slide valve, relieve the excess internal pressure in the screw compressor during over-pressure situations. The over-pressure situation occurs when the internal pressure of the screw compressor exceeds the maximum allowable internal pressure of the screw compressor. During over-pressure situations, the internal pressure relief valves relieve the excess internal pressure from the discharge side to the suction side, thereby preventing damage to the screw compressor. Moreover, by fitting the internal pressure relief valves in the slide valve, the amount of casting material and the cost of manufacturing the rotor case reduces, resulting in a reduction of the overall size and weight of the screw compressor.

BRIEF DESCRIPTION OF THE DRAWINGS

Various embodiments of the invention will hereinafter be described in conjunction with the appended drawings, provided to illustrate and not to limit the invention, wherein like designations denote like elements, and in which.

DESCRIPTION OF PREFERRED EMBODIMENTS

Various embodiments of the invention relate to a screw compressor for compressing a refrigerant in a refrigeration system. More specifically, the embodiments relate to the positioning of internal pressure relief valves in the screw compressor. The positioning of these internal pressure relief valves depends on various factors such as the size and weight of the screw compressor, the amount of casting material required, and the cost of manufacturing the rotor case of the screw compressor.

Figure 1:
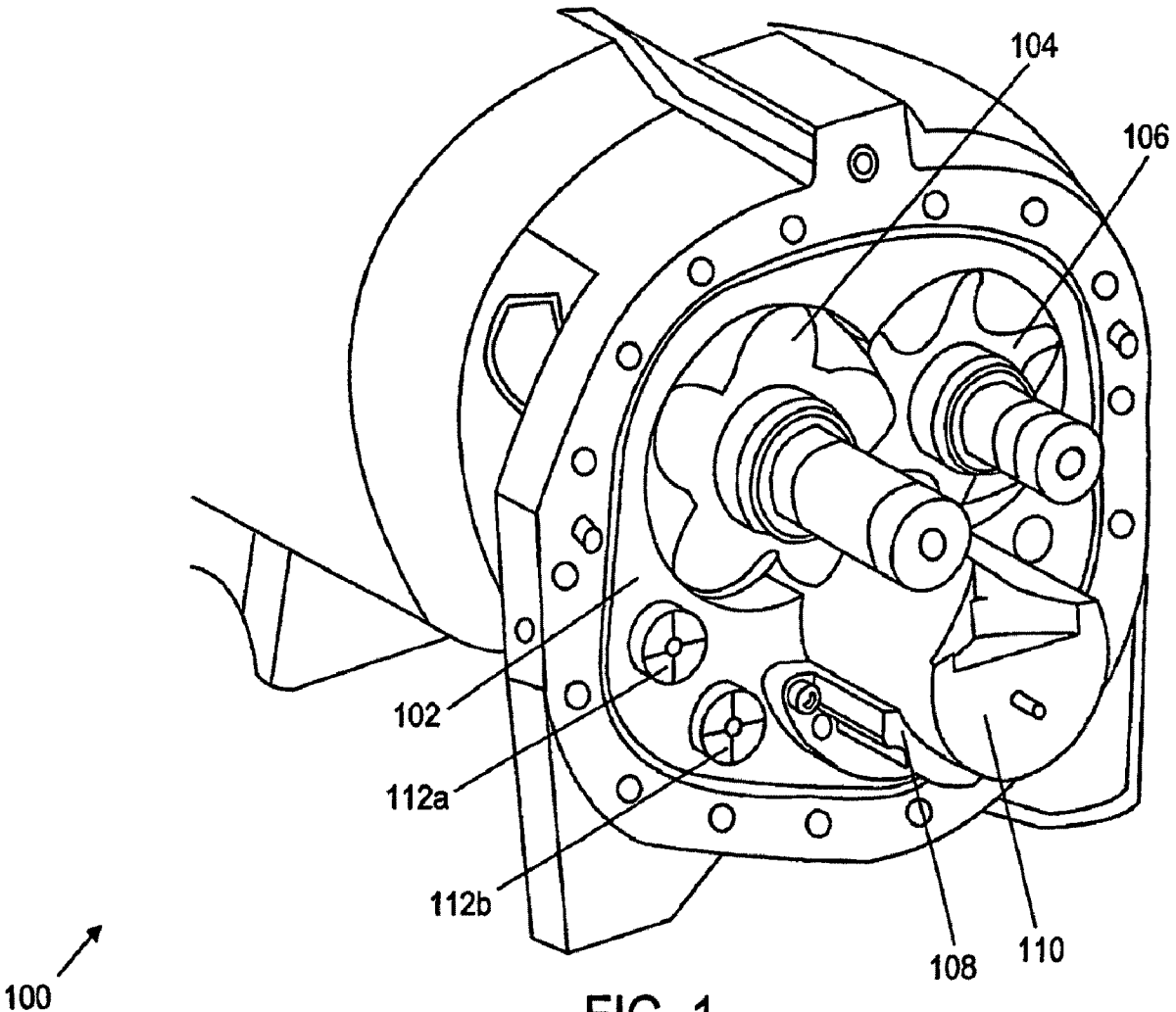
FIG. 1 illustrates a view of a conventional screw compressor with its components.
Figure 2:
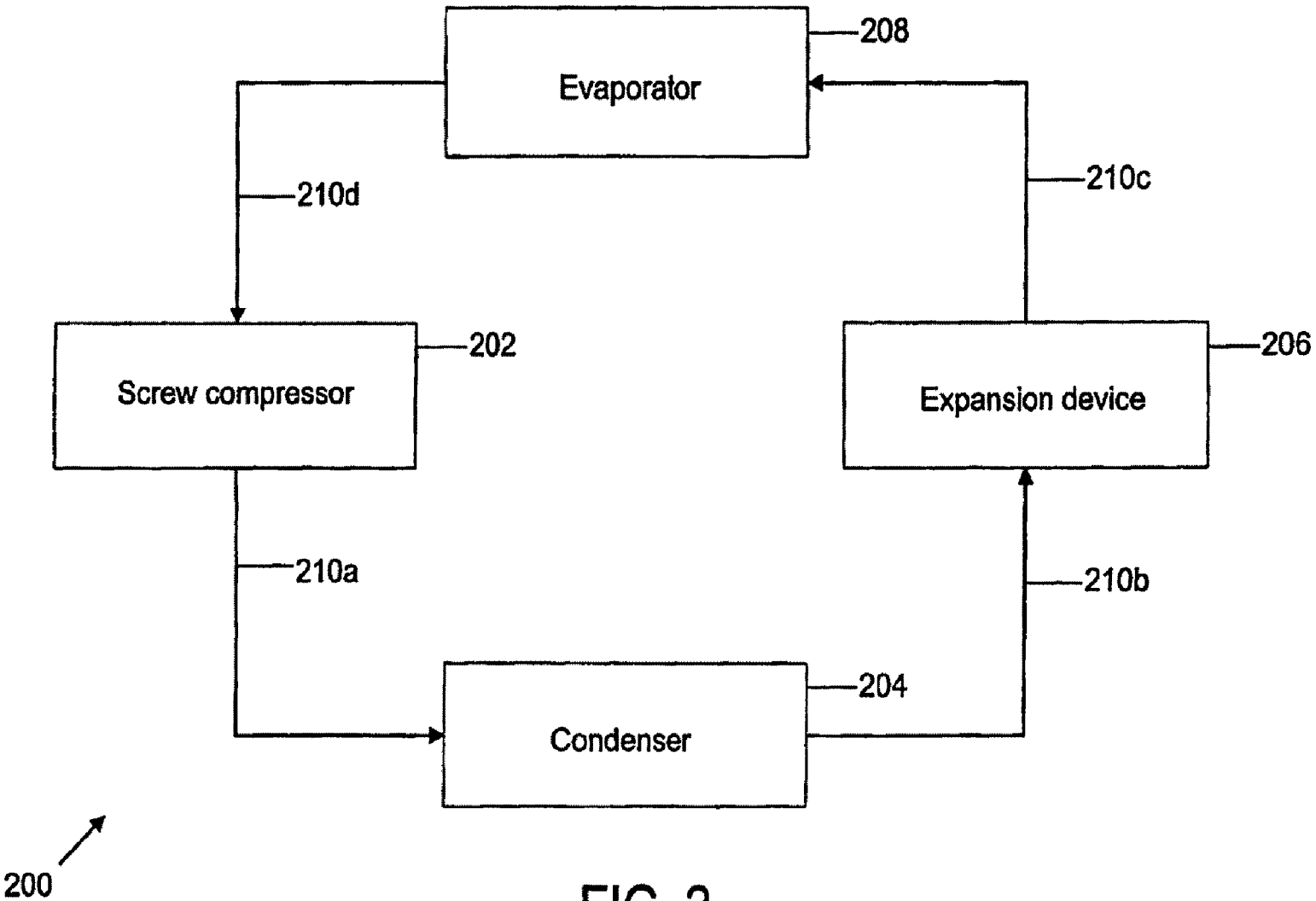
FIG. 2 illustrates a block diagram depicting the components of a refrigeration system, in accordance with an embodiment of the invention.

FIG. 2 illustrates a block diagram depicting the components of a refrigeration system 200, in accordance with an embodiment of the invention. Refrigeration system 200 includes a screw compressor 202, a condenser 204, an expansion device 206, and an evaporator 208. Screw compressor 202 can be an oil type compressor, an oil-free type compressor, and the like. An oil type screw compressor utilizes oil for lubricating the bearings and for cooling the internal components of the screw compressor. Connectors 210*a*, 210*b*, 210*c*, and 210*d*, hereinafter referred to as 'connectors 210', indicate the direction in which a refrigerant flows from one component to another in refrigeration system 200. A refrigerant is a medium of heat transfer that absorbs heat from evaporator 208 and dissipates heat at condenser 204, thereby cooling refrigeration system 200. The refrigerant can be ammonia, Freon, halocarbons, hydrocarbons, and the like. The refrigerant enters screw compressor 202 in a gaseous state, hereinafter referred to as 'refrigerant gas'. The refrigerant gas gets compressed to a high pressure in screw compressor 202. The resulting high-pressure refrigerant gas enters condenser 204, where it is liquefied by heat exchange with the air or water present in condenser 204. Thereafter, the resulting refrigerant liquid is expanded in expansion device 206 and is brought down to a low pressure and temperature. The low-pressure, low-temperature refrigerant liquid is then supplied to evaporator 208. In evaporator 208, the refrigerant liquid absorbs the heat present in evaporator 208 and changes into a gaseous state, thereby cooling refrigeration system 200. Subsequently, the refrigerant gas thus formed leaves evaporator 208 and is compressed in screw compressor 202, thereby completing a refrigeration cycle.

Figure 3:
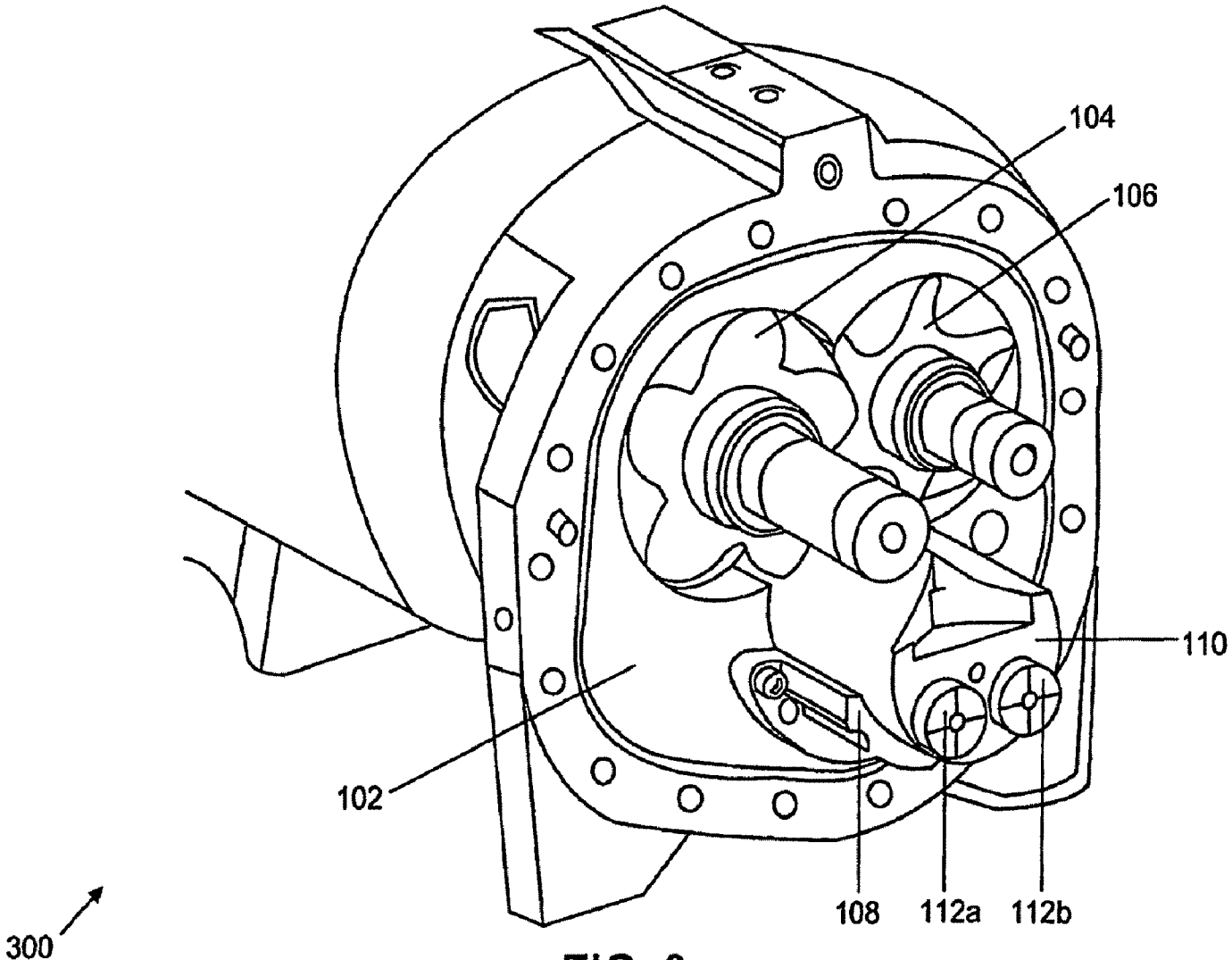
FIG. 3 illustrates a view of a screw compressor, showing two internal pressure relief valves mounted in a slide valve, in accordance with an embodiment of the invention.

FIG. 3 illustrates a view of screw compressor 300, showing two internal pressure relief valves 112*a* and 112*b* mounted in slide valve 110, in accordance with an embodiment of the invention. Screw compressor 300 includes a rotor case 102, a slide valve supporting member 108, a slide valve 110, and two internal pressure relief valves 112*a* and 112*b*. Rotor case 102 accommodates a primary helical rotor 104 and a secondary helical rotor 106. Primary helical rotor 104 and secondary helical rotor 106 together compress the refrigerant gas in rotor case 102. Internal pressure relief valves 112*a* and 112*b* are mounted in slide valve 110 to relieve excess internal pressure from the discharge side to the suction side of screw compressor 300, thereby preventing damage to screw compressor 300. The suction side refers to the inlet side through which the refrigerant gas enters screw compressor 300 at suction pressure. The discharge side refers to the outlet side through which the refrigerant gas is discharged out of screw compressor 300 at discharge pressure.

Conventionally mounted internal pressure relief valves 112*a* and 112*b* take a lot of space in screw compressor 300. This increases the amount of casting material required and the cost of manufacturing rotor case 102 of screw compressor 300. The casting material can be cast steel, gray cast iron casing, nodular iron casing, and the like. Embodiments of the invention describe mounting internal pressure relief valves 112*a* and 112*b* in slide valve 110 of screw compressor 300. This reduces the amount of casting material required and the cost of manufacturing rotor case 102. The reduction in the amount of casting material required and the cost of manufacturing rotor case 102 does not affect the normal functioning of slide valve 110, internal pressure relief valves 112*a* and 112*b*, and screw compressor 300.

Figure 4:
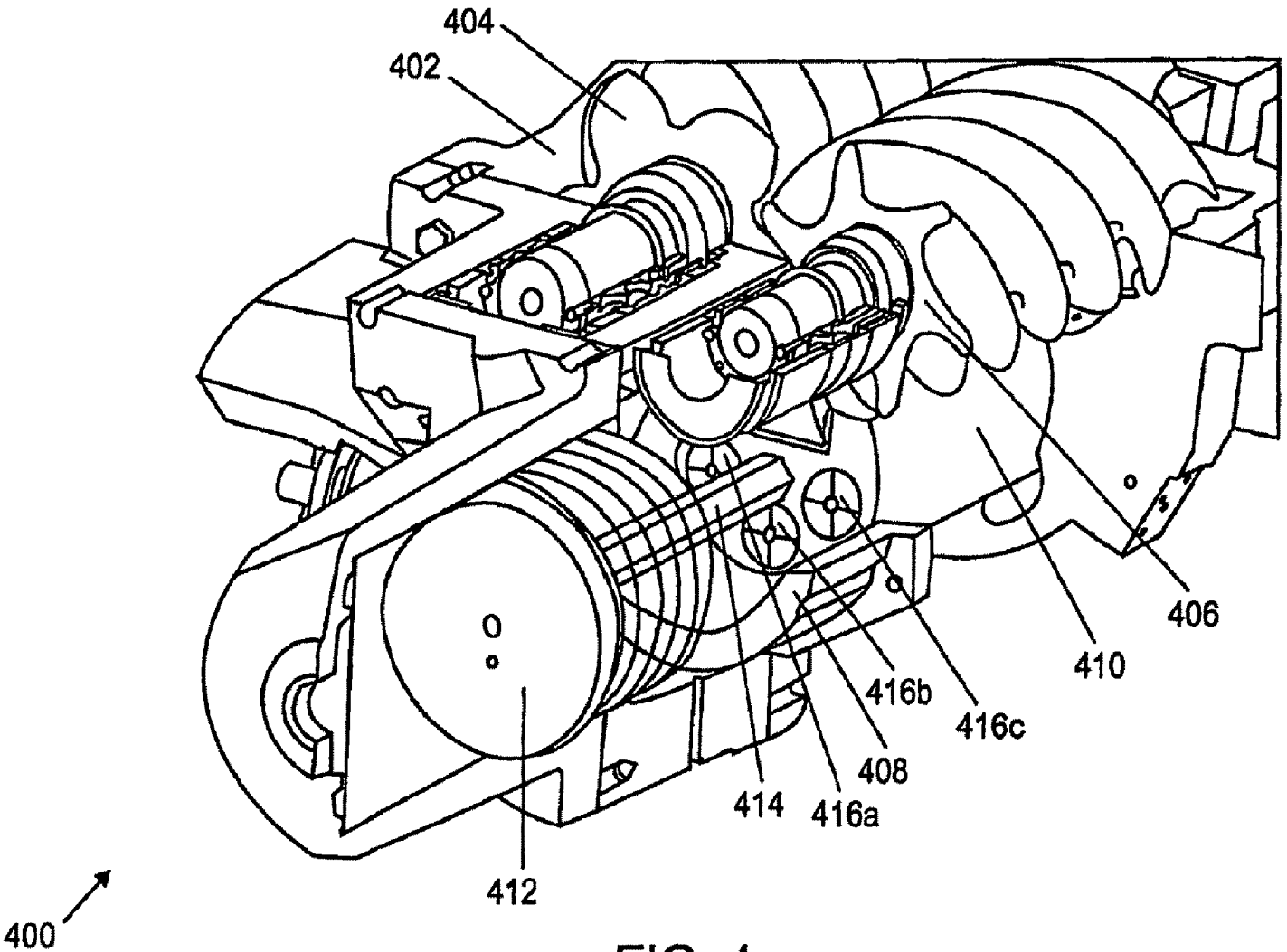
FIG. 4 illustrates a view of a screw compressor, showing three internal pressure relief valves housed in a slide valve, in accordance with an embodiment of the invention.

FIG. 4 illustrates a view of screw compressor 400, showing three internal pressure relief valves 416*a*, 416*b*, and 416*c* housed in slide valve 410, in accordance with an embodiment of the invention. Screw compressor 400 includes a rotor case 402, a primary helical rotor 404, a secondary helical rotor 406, a slide valve supporting member 408, a slide valve 410, a piston 412, and a piston rod 414. Primary helical rotor 404 is intermeshed with secondary helical rotor 406, to trap and compress the refrigerant gas between the inner walls of rotor case 402 and the helical grooves of primary helical rotor 404 and secondary helical rotor 406. Slide valve supporting member 408 is fixed on an inner wall of rotor case 402. Slide valve 410 moves axially on slide valve supporting member 408. Piston rod 414 is connected to slide valve 410 on one side and to piston 412 on the other.

Further, it should be noted that screw compressor 400 can include more than one secondary helical rotor. All the secondary helical rotors can be intermeshed with the primary helical rotor 404. Although the invention has been discussed with respect to specific embodiments thereof, these embodiments are merely illustrative, and not restrictive, of the invention.

Figure 5:
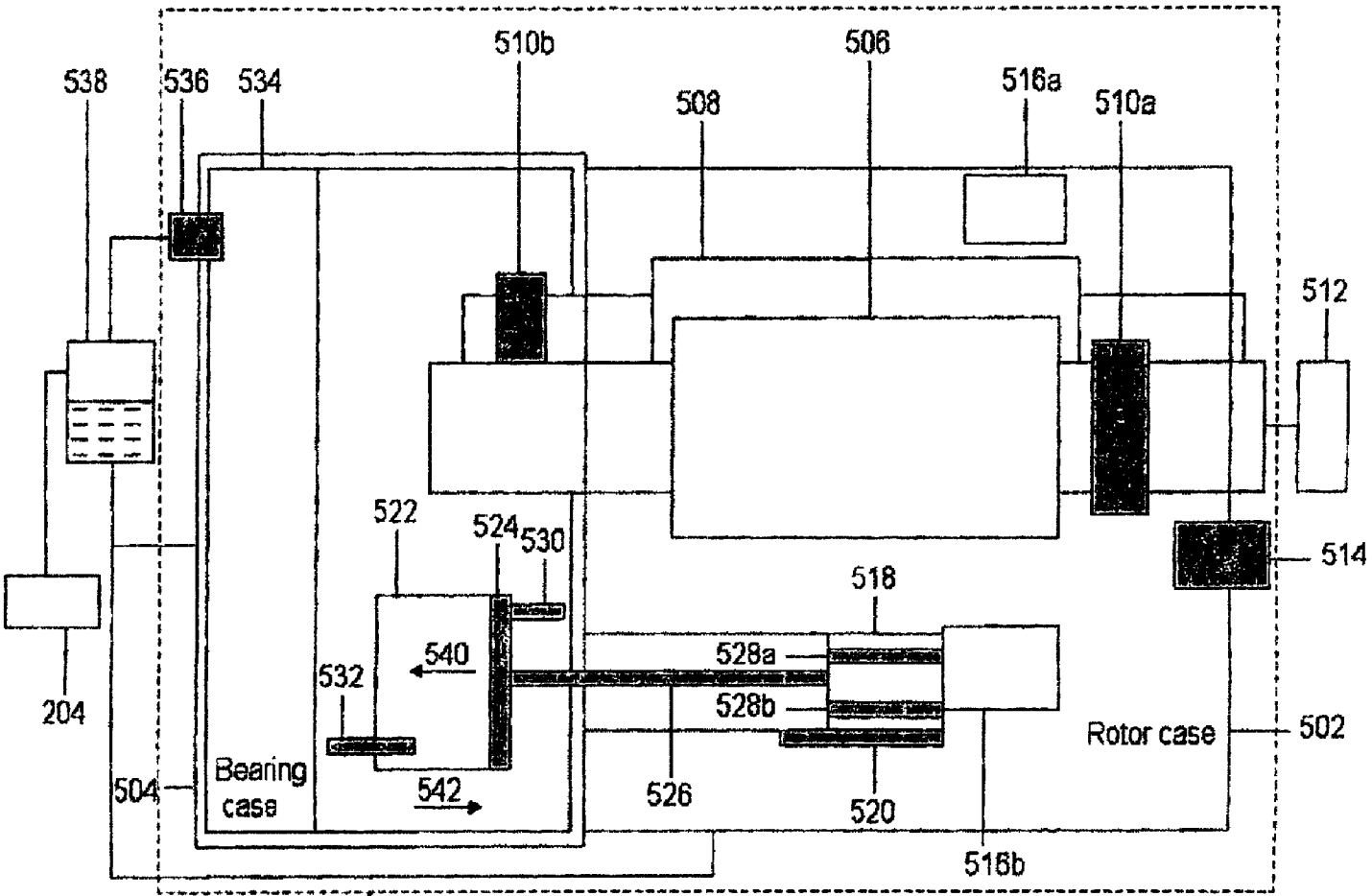
FIG. 5 illustrates a block diagram depicting various components of a screw compressor, in accordance with an embodiment of the invention.

FIG. 5 illustrates a block diagram showing various components of a screw compressor 500, in accordance with an embodiment of the invention. Screw compressor 500 can be a hermetic screw compressor, a semi-hermetic screw compressor, and the like. A hermetic screw compressor is a completely sealed and airtight screw compressor. Screw compressor manufacturers make hermetic or semi-hermetic screw compressors to achieve higher efficiency, minimum leakage, ease of service, and volume production (of discharged refrigerant gas). The selection of a hermetic or semi-hermetic screw compressor depends on factors such as the area of application, the refrigerant to be used, and the manufacturer of the screw compressor.

Screw compressor 500 includes a rotor case 502, and a bearing case 504. Rotor case 502 includes a primary helical rotor 506, a secondary helical rotor 508, a bearing 510*a*, an inlet opening 514, suction ports 516*a* and 516*b*, a slide valve 518, a slide valve supporting member 520, and two internal pressure relief valves 528*a* and 528*b*. Bearing case 504 includes a bearing 510*b*, a hydraulic cylinder 522, a piston 524, a piston rod 526, hydraulic fluid apertures 530 and 532, a discharge chamber 534, and a discharge outlet 536. An electric motor 512 and an oil-separating module 538 are connected to screw compressor 500.

In rotor case 502, primary helical rotor 506 is intermeshed with secondary helical rotor 508. In rotor case 502, a shaft of primary helical rotor 506 is supported by bearing 510*a*. Similarly, in bearing case 504, a shaft of secondary helical rotor 508 is supported by bearing 510*b*. The shaft of primary helical rotor 506 is coupled to a prime mover such as electric motor 512, which drives primary helical rotor 506. In an embodiment of the invention, electric motor 512 can be placed inside rotor case 502. In another embodiment of the invention electric motor 512 can be placed outside rotor case 502. Due to the intermeshing between primary helical rotor 506 and secondary helical rotor 508, secondary helical rotor 508 is driven in a counter-rotating motion by primary helical rotor 506.

Further, slide valve 518 in the inner wall of rotor case 502 controls the compression capacity of screw compressor 500. The compression capacity of screw compressor 500 refers to the volume of refrigerant gas being compressed and discharged from screw compressor 500. Slide valve 518 slides axially on slide valve supporting member 520, which is fixed on the inner wall of rotor case 502. Slide valve 518 is driven by piston 524, which is accommodated in hydraulic cylinder 522. Piston rod 526 connects slide valve 518 and piston 524. Hydraulic cylinder 522, piston 524 and piston rod 526, together, constitute a driving module. The driving module facilitates driving slide valve 518 axially.

The refrigerant gas leaving the evaporator enters screw compressor 500 through inlet opening 514. The refrigerant gas flows into suction port 516*a* and enters a working chamber, which is defined by the space between inner walls of rotor case 502. Primary helical rotor 506 and secondary helical rotor 508 rotate in the working chamber to compress the refrigerant gas to high pressure. Further, the compressed refrigerant gas flows from the working chamber and gets collected in discharge chamber 534 of bearing case 504. Thereafter, the refrigerant gas is forwarded to oil-separator module 538 located outside screw compressor 500 through discharge outlet 536. In an embodiment of the invention, oil-separator module 538 can be located inside bearing case 504 before discharge chamber 534. In another embodiment of the invention, oil-separator module 538 can be placed outside screw compressor 500 after discharge outlet 536. In oil-separator module 538, the oil present in the compressed refrigerant gas is separated. The resulting compressed refrigerant gas which is free from oil enters condenser 204.

Screw compressor 500 can be an oil type screw compressor, oil-free type screw compressor, and the like. Oil type screw compressors utilize oil to lubricate the bearings, to cool the internal components, and to seal the spaces between the inner walls of the rotor case and the helical rotors. For example, if screw compressor 500 is oil type, then oil is utilized to lubricate bearings 510*a* and 510*b*, to cool the internal components and to seal the spaces between the inner walls of rotor case 502 and helical rotors 506 and 508. Screw compressors use hydraulic fluids to actuate the piston, to drive the slide valve axially. The hydraulic fluid can be oil, refrigerant gas, and the like. For example, if screw compressor 500 is oil type, oil is used to actuate piston 524. Similarly, an oil-free type compressor uses the refrigerant gas to actuate the piston. Therefore, to actuate piston 524, hydraulic cylinder 522 is provided with two hydraulic fluid apertures 530 and 532, for the hydraulic fluid to enter hydraulic cylinder 522.

The position of slide valve 518, covering suction port 516*b*, is referred to as a 'full-load position'. In the full-load position, the volume of refrigerant gas entering screw compressor 500 through inlet opening 514 is fully utilized during compression. In order to vary the load position, slide valve 518 needs to be actuated so that it uncovers suction port 516*b* and exposes the working chamber of rotor case 502 to suction port 516*b*. To achieve this, hydraulic cylinder 522 is supplied with oil through aperture 530. To vary the load position, piston 524 moves slide valve 518 in the direction of arrow 540. This exposes the working chamber to suction port 516*b*, thereby venting the refrigerant gas present in the working chamber to suction port 516*b*. Further the volume of refrigerant gas present in the working chamber varies. Consequently, the compression capacity of screw compressor 500 varies. In an embodiment of the invention, if the volume of refrigerant gas present in the working chamber is decreased, the compression capacity of screw compressor 500 is reduced. In another embodiment of the invention, if the compression capacity of screw compressor 500 needs to be increased, hydraulic cylinder 522 is supplied with hydraulic fluid through aperture 532. As a result, piston 524 pushes slide valve 518 in the direction of arrow 542, covering suction port 516*b*. This is followed by the compression process, thereby increasing the compression capacity of screw compressor 500.

During the process of compression in screw compressor 500, the internal pressure of screw compressor 500, on the discharge side, should not be allowed to exceed the maximum allowable internal pressure of screw compressor 500. This situation in which the internal pressure does not exceed the maximum allowable internal pressure of screw compressor 500 is referred to as 'normal-pressure situation'. Further, a situation in which the internal pressure exceeds the maximum allowable internal pressure of screw compressor 500 is referred to as 'over-pressure situation'. The over-pressure situation can damage screw compressor 500. To avoid this damage, slide valve 518 is fitted with two internal pressure relief valves 528*a* and 528*b*, hereinafter referred to as 'valve 528' which relieve pressure at a pre-determined setting (pressure difference).

Figure 6:
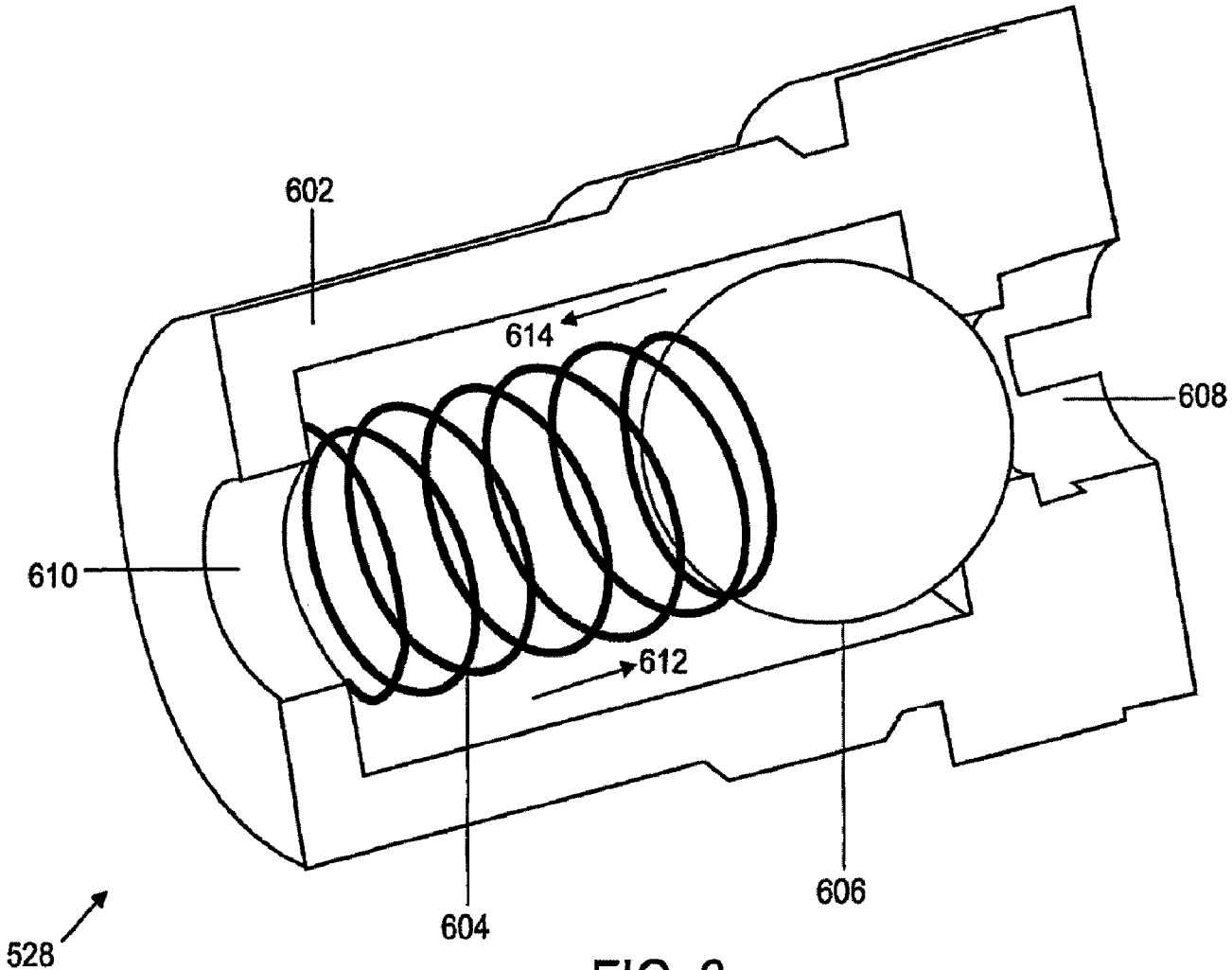
FIG. 6 illustrates a cross sectional view of a valve with its components for relieving internal pressure in a screw compressor, in accordance with an embodiment of an invention.

FIG. 6 illustrates a cross sectional view of a valve 528 with its components for relieving internal pressure in a screw compressor, in accordance with an embodiment of the invention. Valve 528 comprises a valve body 602. Valve body 602 acts as housing for the internal components of valve 528. Valve body 602 includes a valve spring 604, a valve ball 606, a valve inlet 608 (on the discharge side), and a valve outlet 610 (on the suction side). During normal-pressure situations, valve ball 606 closes valve inlet 608 from inside, which does not allow the refrigerant gas to enter valve 528. This is due to the actuating force exerted on valve ball 606 by valve spring 604. The actuating force is exerted by valve spring 604 in the direction indicated by an arrow 612. This position is referred to as a 'closed position' of valve 528. During over-pressure situations, the refrigerant gas at the discharge side forces valve ball 606 against the actuating force of valve spring 604. The direction of force exerted on valve ball 606 against the actuating force of valve spring 604 is indicated by an arrow 614. Consequently, the refrigerant gas enters through valve inlet 608 and leaves through valve outlet 610, thereby relieving the excess internal pressure from the discharge side to the suction side of screw compressor 500. Further, when the internal pressure at the discharge side drops below the maximum allowable internal pressure of screw compressor 500, normal-pressure situation arises. During normal-pressure situation, valve spring 604 exerts the actuating force on valve ball 606. Consequently, valve ball 606 is pushed back to close valve inlet 608, thus bringing back valve 528 to the closing position.

In accordance with another embodiment of the invention, valve ball is replaced by a valve piston. The valve piston includes a valve seat that is attached to first end of the valve piston. The second end of the valve piston is attached to the valve spring. The valve seat can be made of a soft material such as Teflon, and the like. The valve seat rests on to the inner surface of the valve inlet. The valve piston and the valve seat act as a closing assembly, thereby preventing the refrigerant gas from entering through the valve inlet during normal-pressure situations. During over-pressure situations, the refrigerant gas pushes the valve piston against the actuating force of the valve spring. As a result, the refrigerant gas enters valve 528 through the valve inlet, thereby relieving the excess pressure from the discharge side to the suction side. Further, during normal-pressure situations, the actuating force of valve spring acts on the valve piston. The valve piston is pushed back to close the valve inlet, thus disallowing the refrigerant gas from entering valve 528 through the discharge side.

Various embodiments of the invention provide a screw compressor for compressing a refrigerant in a refrigeration system. Such a screw compressor provides compression capacity control and relieves excess internal pressure during over-pressure situations, thereby preventing the screw compressor from being damaged. Further, various embodiments of the invention provide a cost-effective screw compressor in which the internal pressure relief valves are mounted in the slide valve, thereby reducing the amount of casting material required and the cost of manufacturing the rotor case, as well as the overall weight and size of the screw compressor.

While the various embodiments of the invention have been illustrated and described, it will be clear that the invention is not limited to these embodiments only. Numerous modifications, changes, variations, substitutions and equivalents will be apparent to those skilled in the art, without departing from the spirit and scope of the invention, as described in the claims.

What is claimed is:

1. An apparatus for relieving pressure in a screw compressor, the screw compressor comprising a rotor case, the rotor case comprising a plurality of helical rotors, the plurality of helical rotors comprising a primary helical rotor and at least one secondary helical rotor, the primary helical rotor intermeshed with each of the at least one secondary helical rotor for compressing a refrigerant, the apparatus comprising:

a slide valve supporting member fixed on an inner wall of the rotor case;

a slide valve positioned between the plurality of helical rotors and the slide valve supporting member, the slide valve sliding axially on the slide valve supporting member, the slide valve controlling the volume of refrigerant to be compressed; and at least one internal pressure relief valve positioned to relieve said pressure from a discharge side of the compressor to a suction side of the compressor, each of the at least one internal pressure relief valve being fitted in the slide valve, each of the at least one internal pressure relief valve relieving pressure in the screw compressor, the pressure being relieved based on a pre-determined setting.

2. The apparatus according to claim 1, wherein each of the at least one internal pressure relief valve comprises:

a valve inlet, the valve inlet providing an opening to the refrigerant to enter the each of the at least one internal pressure relief valve;

a valve ball, the valve ball closing and opening the valve inlet; and a valve spring, the valve spring moving during the opening and closing of the valve inlet, wherein one end of the valve spring is connected to the valve ball.

3. The apparatus according to claim 1, wherein each of the at least one internal pressure relief valve comprises:

a valve inlet, the valve inlet providing an opening to the refrigerant to enter the each of the at least one internal pressure relief valve;

a valve piston, the valve piston closing and opening the valve inlet;

a valve seat, one end of the valve seat connected to a first end of the valve piston, wherein the valve seat rests on the surface of the valve inlet when the valve piston closes the valve inlet; and a valve spring, one end of the valve spring connected to a second end of valve piston, the valve spring moving during the opening and closing of the valve inlet.

4. The apparatus according to claim 1, wherein each of the at least one internal pressure relief valve is housed in the slide valve.

5. The apparatus according to claim 1, wherein each of the at least one internal pressure relief valve is mounted in the slide valve.

6. The apparatus according to claim 1, wherein the pre-determined pressure difference being the internal pressure of the screw compressor exceeding the maximum allowable internal pressure of the screw compressor.

7. A screw compressor for compressing a refrigerant in a refrigeration system, the screw compressor comprising:

a rotor case;

a plurality of helical rotors, the plurality of helical rotors being placed in the rotor case, the plurality of helical rotors comprising a primary helical rotor and at least one secondary helical rotor, the primary helical rotor being intermeshed with each of the at least one secondary helical rotor;

a slide valve controlling the volume of refrigerant to be compressed; and at least one internal pressure relief valve positioned to relieve pressure from a discharge side of the compressor to a suction side of the compressor, each of the at least one internal pressure relief valve being fitted in the slide valve for relieving pressure from the screw compressor, the pressure being relieved based on a pre-determined setting.

8. The screw compressor according to claim 7, wherein one of the plurality of helical rotors is connected to a prime mover, the prime mover driving the one of the plurality of helical rotors.

9. The screw compressor according to claim 7, wherein the slide valve is connected to a driving module, the driving module moving the slide valve axially.

10. The screw compressor according to claim 9 comprising:

a hydraulic cylinder;

a piston, the piston accommodated in the hydraulic cylinder; and a piston rod, the piston rod comprising:

a first end, the first end connected to the slide valve; and a second end, the second end connected to the piston.

11. The oil type screw compressor according to claim 7 using oil for cooling and sealing a space between the plurality of helical rotors and the inner wall of the rotor case.

12. The screw compressor according to claim 7 being connected to an oil-separating module, the oil-separating module separating oil from the compressed refrigerant.

13. The screw compressor according to claim 7 being an oil-free screw compressor.

14. The screw compressor according to claim 7 being a hermetic screw compressor.

15. The screw compressor according to claim 7 being a semi-hermetic screw compressor.

16. A system for compressing a refrigerant in a refrigeration system, the system comprising:

a plurality of helical rotors, the plurality of helical rotors comprising a primary helical rotor being intermeshed with at least one secondary helical rotor;

an accommodating means for enclosing the plurality of helical rotors;

a slide valve supporting means being fixed on an inner wall of the accommodating means;

a sliding means positioned between the plurality of helical rotors and the slide valve supporting means, the sliding means sliding axially on the slide valve supporting means, the sliding means controlling the volume of refrigerant to be compressed; and a pressure relieving means fitted in the sliding means and positioned to relieve pressure from a discharge side of the compressor to a suction side of the compressor, the pressure being relieved based on a pre-determined setting.

17. The system according to claim 16, wherein the sliding means is connected to a driving module, the driving module moving the sliding means axially.

18. The system according to claim 17 wherein the driving module comprises:

a hydraulic cylinder;

a piston, the piston accommodated in the hydraulic cylinder; and a piston rod, the piston rod comprising:

a first end, the first end connected to the sliding means; and a second end, the second end connected to the piston.

19. The system according to claim 16, wherein the pre-determined setting is a pre-determined pressure difference.

20. The apparatus according to claim 1, wherein the pre-determined setting is a pre-determined pressure difference.

21. The compressor of claim 7 wherein:

the pre-determined setting is a pre-determined pressure difference.

* * * * *